US010801242B1

(12) United States Patent
Dixon et al.

(10) Patent No.: US 10,801,242 B1
(45) **Date of Patent: *Oct. 13, 2020**

(54) DOOR WITH HIDDEN DOOR CLOSER

(71) Applicant: Larson Manufacturing Company of South Dakota, Inc., Brookings, SD (US)

(72) Inventors: Alan M. Dixon, Brookings, SD (US); Michael W. Kondratuk, Brookings, SD (US); Allen E. Lee, Brookings, SD (US); Kelly D. Nordgaard, Gary, SD (US); Jordan A. Richter, Coralville, IA (US); Todd N. Stratmoen, Brookings, SD (US); Bryan P. Zacher, Brookings, SD (US)

(73) Assignee: Larson Manufacturing Company of South Dakota, Inc., Brookings, SD (US)

( * ) Notice: Subject to any disclaimer, the term of this patent is extended or adjusted under 35 U.S.C. 154(b) by 108 days.

This patent is subject to a terminal disclaimer.

(21) Appl. No.: 15/911,690

(22) Filed: Mar. 5, 2018

Related U.S. Application Data

(60) Provisional application No. 62/467,491, filed on Mar. 6, 2017.

(51) Int. Cl.
*E05F 11/24* (2006.01)
*E05F 1/10* (2006.01)
*E05F 3/22* (2006.01)

(52) U.S. Cl.
CPC ..... *E05F 1/105* (2013.01); *E05F 3/227* (2013.01); *E05Y 2600/41* (2013.01); *E05Y 2600/46* (2013.01)

(58) Field of Classification Search
CPC ..... E05F 1/105; E05F 3/227; E05Y 2600/41; E05Y 2600/46
USPC ..... 49/339, 340, 341, 342, 343, 344, 345, 49/346
See application file for complete search history.

(56) References Cited

U.S. PATENT DOCUMENTS

| | | | | |
|---|---|---|---|---|
| 2,958,089 | A * | 11/1960 | Roehm | E05C 17/24 16/49 |
| 3,605,339 | A | 9/1971 | Catlett et al. | |
| 4,348,835 | A | 9/1982 | Jones et al. | |
| 5,829,508 | A * | 11/1998 | DeBower | E05F 3/221 160/371 |
| 6,049,287 | A | 4/2000 | Yulkowski | |
| 6,481,160 | B1 | 11/2002 | Kowalczyk | |
| 6,581,332 | B1 | 6/2003 | Kim | |
| 6,588,153 | B1 | 7/2003 | Kowalczyk | |
| 8,405,337 | B2 | 3/2013 | Gebhart et al. | |
| 8,844,200 | B2 | 9/2014 | Yulkowski et al. | |
| 9,556,659 | B2 | 1/2017 | Fan | |
| 9,822,569 | B2 * | 11/2017 | Wang | E05F 1/1091 |

(Continued)

OTHER PUBLICATIONS

Office action, U.S. Appl. No. 15/382,275, dated May 16, 2018, 21 pages.

*Primary Examiner* — Jerry E Redman
(74) *Attorney, Agent, or Firm* — Kagan Binder, PLLC

(57) ABSTRACT

The present disclosure describes various embodiments of a concealed or hidden door closer that is installed in a drip cap of a door assembly. In some embodiments, the door frame and door closer components are configured to allow the door assembly to be readily installed as either a left or a right hand hinged door.

20 Claims, 15 Drawing Sheets

(56) References Cited

U.S. PATENT DOCUMENTS

| | | | | |
|---|---|---|---|---|
| 2002/0108312 | A1 | 8/2002 | Abdella et al. | |
| 2005/0193632 | A1 | 9/2005 | Orban et al. | |
| 2006/0150514 | A1* | 7/2006 | Miller | E05C 17/32 49/345 |
| 2009/0249699 | A1* | 10/2009 | Yulkowski | E05F 15/00 49/349 |
| 2013/0118079 | A1 | 5/2013 | Yulkowski et al. | |
| 2016/0060939 | A1* | 3/2016 | Ding | B66F 7/28 49/344 |
| 2018/0016832 | A1* | 1/2018 | Rodriguez Rodriguez | E05D 15/06 |

* cited by examiner

DOOR WITH HIDDEN DOOR CLOSER

CROSS-REFERENCED TO RELATED APPLICATIONS

This non-provisional patent application claims the benefit of United States provisional patent application having Ser. No. 62/467,491, filed on Mar. 6, 2017, and titled "DOOR WITH HIDDEN DOOR CLOSER," wherein the entirety of this provisional patent application is incorporated herein by reference.

Commonly owned pending applications that report various embodiments of a door with a hidden closer include U.S. patent application Ser. No. 15/382,275 filed Dec. 16, 2016 and a continuation thereof as Ser. No. 16/914,850 filed Jun. 29, 2020; Ser. No. 15/385,091 filed Dec. 20, 2016; and Ser. No. 15/911,639 filed Mar. 5, 2018.

TECHNICAL FIELD

The present disclosure is generally directed to a door assembly having a concealed or hidden door closer. In particular, the hidden door closer may be inserted or housed in a pocket in a drip cap mounted to the upper header of a framed door opening. The inserted door closer is attached to a closer arm that is connected to the door. In use, the door closer provides sufficient force to the closer arm to move the door from an opened position to a closed position.

BACKGROUND

Door closers have been used for many years. These closers run the gamut from weights which travel about a pulley to open and close the door to spring-loaded hinges in which a torsion spring is coaxial with the hinge pin. Other closers, for example, use one or more externally mounted pneumatic or hydraulic cylinders while still other closers use a complex hydraulic mechanism in combination with a folding linkage attached to the top of the door. Not only do these reported closer designs vary in effectiveness in reliably closing the door, many of these closer designs also detract from the aesthetic appearance of the door since they are mounted as an appendage to the surface of the door.

Hollow interior portions of a wide variety of doors, such as screen doors, storm doors, exterior doors, or interior doors, lend themselves to the potential of mounting a door closer in the interior structure of these doors. U.S. Pat. No. 5,829,508, for example, reports an interior mounted door closer with a spring-mounted, sliding closer mechanism fitted in the upper part of the door. This reported closer includes a number of moving parts that are installed in the upper internal section of the door. There is a need for a hidden closer that is simply easier to install and use than previously reported closers.

SUMMARY

The present disclosure describes various embodiments of a concealed or hidden door closer that is installed in an upper rail of a door assembly. In some embodiments, the door frame and door closer components are configured to allow the door assembly to be readily installed as either a left or a right hand hinged door.

In one embodiment (2 Closer Pockets in Drip Cap), this disclosure describes a door assembly, comprising:

- a door having first and second vertical stiles attached to upper and lower horizontal rails;

- a drip cap having a horizontal body with first and second ends having two closer pockets located in regions of the horizontal body adjacent to the first and second ends;
- a closer insertable into one of the pockets of the drip cap comprising a closer attachable to the drip cap, and a vertical pinion rotatably connected to an internal biasing mechanism such as a biasing spring and having at least one connecting stud extending through the closer body, wherein the vertical pinion provides sufficient rotational force to move the door from an opened position to a closed position; and
- a closer arm having an attachment fixture on one end of the closer arm attachable to the vertical pinion connecting stud and an attachment fixture on the opposite end of the closer arm attachable to the door, the closer arm comprising at least two segments connectable at a hinge.

In this embodiment as well as in other embodiments described below, the door assembly may be configured and/or oriented to be installed as either a left hinged or a right hinged door. In a left hinged door the vertical hinge stile and vertical hinge frame are on the left side of the door when viewed from the exterior side of the door, while in a right hinged door the vertical hinge stile and vertical hinge frame are on the right side of the door. In some embodiments, for example, the door frame may be essentially symmetrical about a vertical axis with both the left and right vertical stiles capable of receiving or being fitted with an external latch mechanism for either a left hinged or a right hinged door. Alternatively, an installer may drill or cut either the right or left vertical stile at the assembly site so that the vertical stile may receive or be fitted with an internal latch mechanism for either a left hinged or right hinged door. In other embodiments, for example, the door frame may be essentially symmetrical about a horizontal axis and the vertical latch stile may include a precut latch pocket. In this embodiment with two closer pockets in a drip cap, the door frame may be oriented with the vertical latch stile to the right side of the door and the vertical latch stile may receive or be fitted with an internal latch mechanism.

Alternatively, this door frame may be oriented with the vertical latch stile to the left side of the door by rotating the door frame 180° top-to-bottom for a right hinged door (while maintaining the orientation of the exterior and interior for the left hinged door). Those skilled in the art will understand that there are other configurations and/or orientations of the door assemblies of this disclosure that may be installed as both left hinged or right hinged doors. Various configurations and/or orientations for left hinged and right hinged doors are described below, for example, when referring to FIGS. 1-3.

In another embodiment (Channel in Drip Cap), this disclosure describes a door assembly, comprising:

- a door having one or more vertical stiles attached to upper and lower horizontal rails;
- a drip cap having a horizontal body with first and second ends having an internal channel extending between the first and second ends;
- a closer insertable into the internal channel of the drip cap comprising a closer body attachable to the drip cap, and a vertical pinion rotatably connected to an internal biasing mechanism such as a biasing spring and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and an attachment fixture on the opposite end of the closer arm attachable to the door, the closer arm comprising at least two segments connectable at a hinge.

Those skilled in the art will readily recognize that this embodiment of a door assembly may be configured and/or oriented for either a left hinged or a right hinged installation as described above.

In still another embodiment (Center Closer Pocket in Drip Cap), this disclosure describes a door assembly, comprising:

a door having first and second vertical stiles attached to upper and lower horizontal rails;

a drip cap having a horizontal body with first and second ends having a closer pocket in a center region of the horizontal body between the first and second ends;

a closer insertable into the pocket of the drip cap comprising a closer body attachable to the drip cap, and a vertical pinion rotatably connected to an internal biasing mechanism such as a biasing spring and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and an attachment fixture on the opposite end of the closer arm attachable to the door, the closer arm comprising at least two segments connectable at a hinge.

Those skilled in the art will readily recognize that this embodiment of a door assembly may be configured and/or oriented for either a left hinged or a right hinged installation as described above.

In still another embodiment (Left or Right Hinged Door with Pocket in Drip Cap), this disclosure describes a door assembly, comprising:

a door having first and second vertical stiles attached to upper and lower horizontal rails;

a drip cap having a horizontal body with first and second ends having one closer pocket located in a region of the horizontal body adjacent one of the ends of the drip cap for either a left hinged or a right hinged door assembly;

a closer insertable into the pocket of the drip cap comprising a closer body attachable to the drip cap, and a vertical pinion rotatably connected to an internal biasing mechanism such as a biasing spring and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and an attachment fixture on the opposite end of the closer arm attachable to the door, the closer arm comprising at least two segments connectable at a hinge.

In the embodiments set out above, the door may be in a variety of configurations such as, for example, a full view door, a high view door, or a mid-view door. The described doors may also be interchangeable doors or self-storing doors. For example, in some embodiments the glass and screen panels may be exchanged seasonally. Alternatively, the glass and screen panels may be stored in designated sections of the door and either the glass or screen may be moved into place when it is desired to have either the screen or the glass in view.

In addition, the embodiments set out above may include additional components. In some of the described embodiments, the door assembly may include a vertical hinge frame attached to at least one of the vertical stiles to provide either the left or right hinged door. In other embodiments, the door assembly may also include latching components attachable to at least one of the vertical stiles where the latch mechanism is externally mounted to at least one of the vertical stiles, or alternatively is internally mounted in a latch pocket in at least one of the vertical stiles. In still other embodiments, the door assembly includes a vertical latch frame attached to a door jamb adjacent at least one of the vertical stiles where the vertical latch frame has optional fixtures to receive the latching components of the latch mechanism.

Further, various embodiments of a closer may be used with the disclosed door assemblies. The closer, for example, may include an internal biasing mechanism such as a biasing spring that provides a torsional force or linear force. Other alternative biasing mechanisms may include compressible and/or expandable materials such as fluids or gases which may be used alone or in combination with, for example, biasing springs. In addition, the closer may be set to close the door at a consistent speed or a variable speed. In some embodiments, the closer may have a vertical pinion that has upper and lower connecting studs extending through a top and bottom of the closer body. In this embodiment, a lower connecting stud will rotate clockwise when the closer is in a first orientation in the closer pocket, and counterclockwise when the closer is in a second orientation in the closer pocket. In other embodiments, the closer may have a connecting stud that rotates either clockwise or counterclockwise when displaced from a center biased position. In still other embodiments, the closer may include a dampener component to control the closing speed of the door.

In an alternative embodiment, this disclosure describes a door assembly kit comprising:

a door having first and second vertical stiles attached to upper and lower horizontal rails;

a drip cap having a horizontal body with first and second ends optionally having two closer pockets located in regions of the horizontal body adjacent to the first and second ends, an internal channel extending between the first and second end, a closer pocket in a center region of the horizontal body between the first and second ends, or one closer pocket located in a region of the horizontal body adjacent one of the ends of the drip cap;

a closer insertable into one of the pockets or the channel of the drip cap comprising a closer body attachable to the drip cap, and a vertical pinion rotatably connected to an internal biasing mechanism such as a biasing spring and having at least one connecting stud extending through the closer body, wherein the vertical pinion provides sufficient rotational force to move the door from an opened position to a closed position;

a closer arm having an attachment fixture on one end of the closer arm attachable to the vertical pinion connecting stud and an attachment fixture on the opposite end of the closer arm attachable to the door, the closer arm comprising at least two segments connectable at a hinge;

an optional expander attachable to the lower horizontal rail;

a latch mechanism having latching components attachable to at least one of the vertical stiles in either an internal or an external configuration;

a vertical latch frame having optional fixtures to receive the latching components of the latch mechanism;

a vertical hinge frame attachable to at least one of the vertical stiles to provide either a left or right hinged door;

an optional cover attachable to the drip cap to conceal at least one of the closer pockets;

an optional hold-open mechanism; and an optional screen insert, or one or more glass inserts, or both.

Those skilled in the art will readily recognize that this embodiment of a door assembly may be configured and/or oriented for either a left hinged or a right hinged installation as described above.

Such door assembly kits may be for a full view door, a high view door, or a mid-view door a as well as an interchangeable door or a self-storing door. For example, in some embodiments the glass, opaque, and/or screen panels may be exchanged seasonally. Alternatively, the glass, opaque, and/or screen panels may be stored in designated sections of the door and either the glass, opaque and/or screen may be moved into place when it is desired to have either the screen or the glass in view.

In another alternative embodiment, this disclosure describes a method of mounting a door within a framed opening comprising:

a) providing a door assembly comprising:

1) a door having first and second vertical stiles attached to upper and lower horizontal rails;

2) a drip cap having a horizontal body with first and second ends optionally having two closer pockets located in regions of the horizontal body adjacent to the first and second ends, an internal channel extending between the first and second end, a closer pocket in a center region of the horizontal body between the first and second ends, or one closer pocket located in a region of the horizontal body adjacent one of the ends of the drip cap;

3) a closer insertable into one of the pockets or the channel of the drip cap comprising a closer body attachable to the drip cap, and a vertical pinion rotatably connected to an internal biasing mechanism such as a biasing spring and having at least one connecting stud extending through the closer body, wherein the vertical pinion provides sufficient rotational force to move the door from an opened position to a closed position;

4) a closer arm having an attachment fixture on one end of the closer arm attachable to the vertical pinion connecting stud and an attachment fixture on the opposite end of the closer arm attachable to the door, the closer arm comprising at least two segments connectable at a hinge;

5) an optional expander attachable to the lower horizontal rail;

6) a latch mechanism having latching components attachable to at least one of the vertical stiles in either an internal or external configuration;

7) a vertical latch frame having optional fixtures to receive the latching components of the latch mechanism;

8) a vertical hinge frame attachable to at least one of the vertical stiles to provide either a left or right hinged door;

9) an optional a cover attachable to the drip cap to conceal at least one of the closer pockets;

10) an optional hold-open mechanism; and 11) an optional screen insert, or one or more glass inserts, or both;

b) attaching the vertical hinge stile of the door assembly to a door jamb with the vertical hinge frame;

c) inserting the closer into one of the pockets or the channel in the drip cap;

d) attaching the closer arm to one of the closer pinion connecting studs;

e) attaching the drip cap to a door header;

f) attaching the vertical latch frame to the door jamb adjacent the vertical latch stile;

g) attaching the latch mechanism externally to or internally in the vertical latch stile;

h) attaching the closer arm to the door;

i) attaching the optional hold-open mechanism;

j) attaching the optional cover to the drip cap to conceal at least one of the unused closer pockets;

k) attaching the optional expander to the lower horizontal rail; and l) attaching the screen insert and/or one or more glass inserts in the door.

In some of the embodiments of this method, the installer will decide to install the door assembly as either a left hinged or right hinged door. In embodiments where the door is essentially symmetrical about a horizontal axis, the installer would understand or be instructed to rotate the door assembly 180° from top to bottom in order to allow either a left hinged or a right hinged installation of the door assembly. In other embodiments where the door is essentially symmetrical about a vertical axis, the installer would understand or be instructed to configure and/or orient the door assembly in order to allow either a left hinged or a right hinged installation of the door assembly.

DETAILED DESCRIPTION

The present disclosure is generally directed to a door assembly having a concealed or hidden door closer. In particular, the door closer may be is inserted in a pocket in a drip cap of the door assembly mounted to the upper header of a door frame. The inserted door closer is attached to a closer arm that is connected to an upper horizontal rail of a door assembly. In use, the door closer provides sufficient force to the closer arm to move the door from an opened position to a closed position.

Figure 1A:
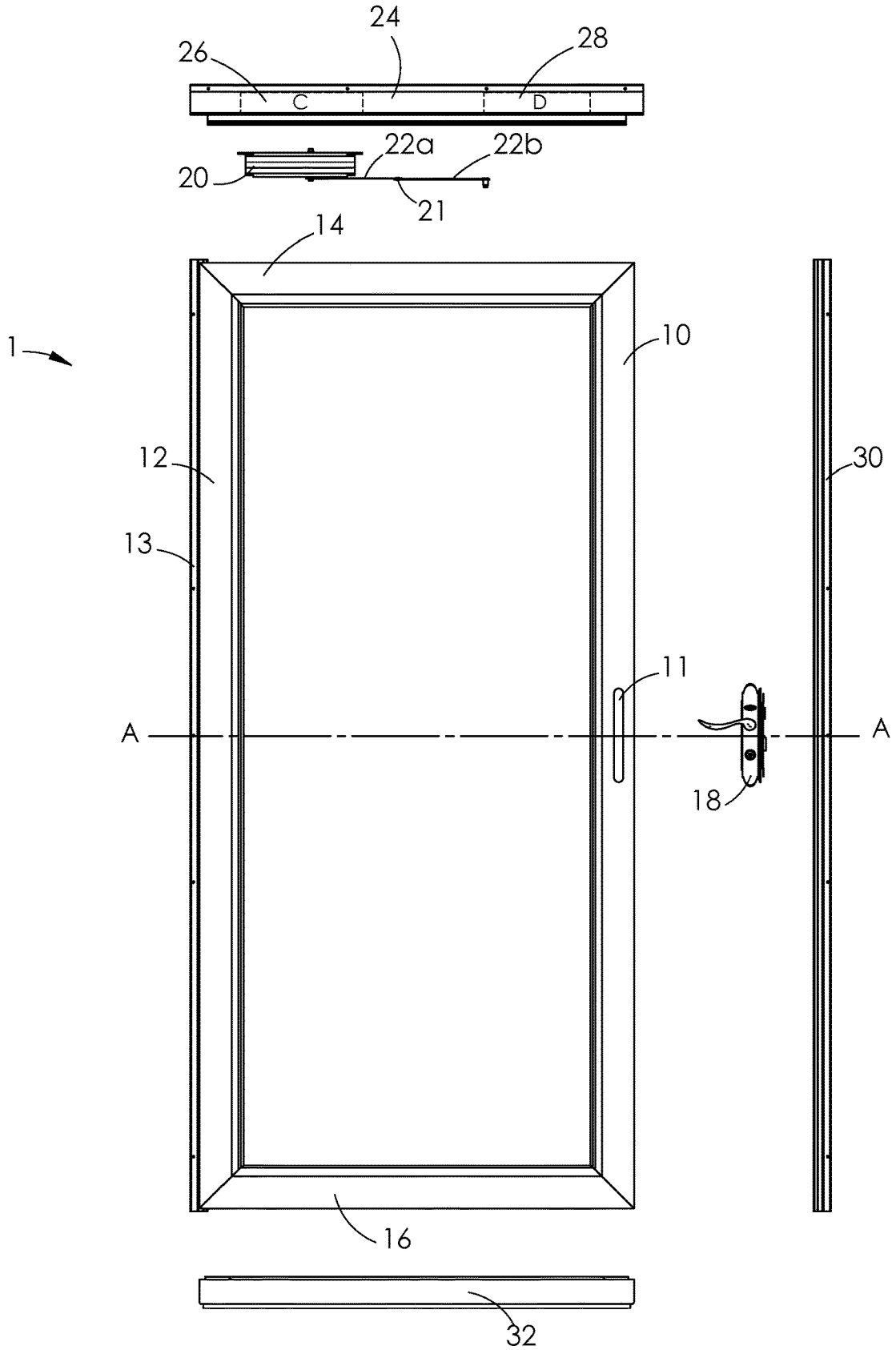
FIGS. 1A and 1B are exploded exterior front views of a left hinged door assembly (1A) and a right hinged door assembly (1B). Each door assembly in FIGS. 1A and 1B includes a door assembly, closer, drip cap having two closer pockets, lock set, vertical latch frame, vertical hinge frame and lower rail expander.
Figure 1B:
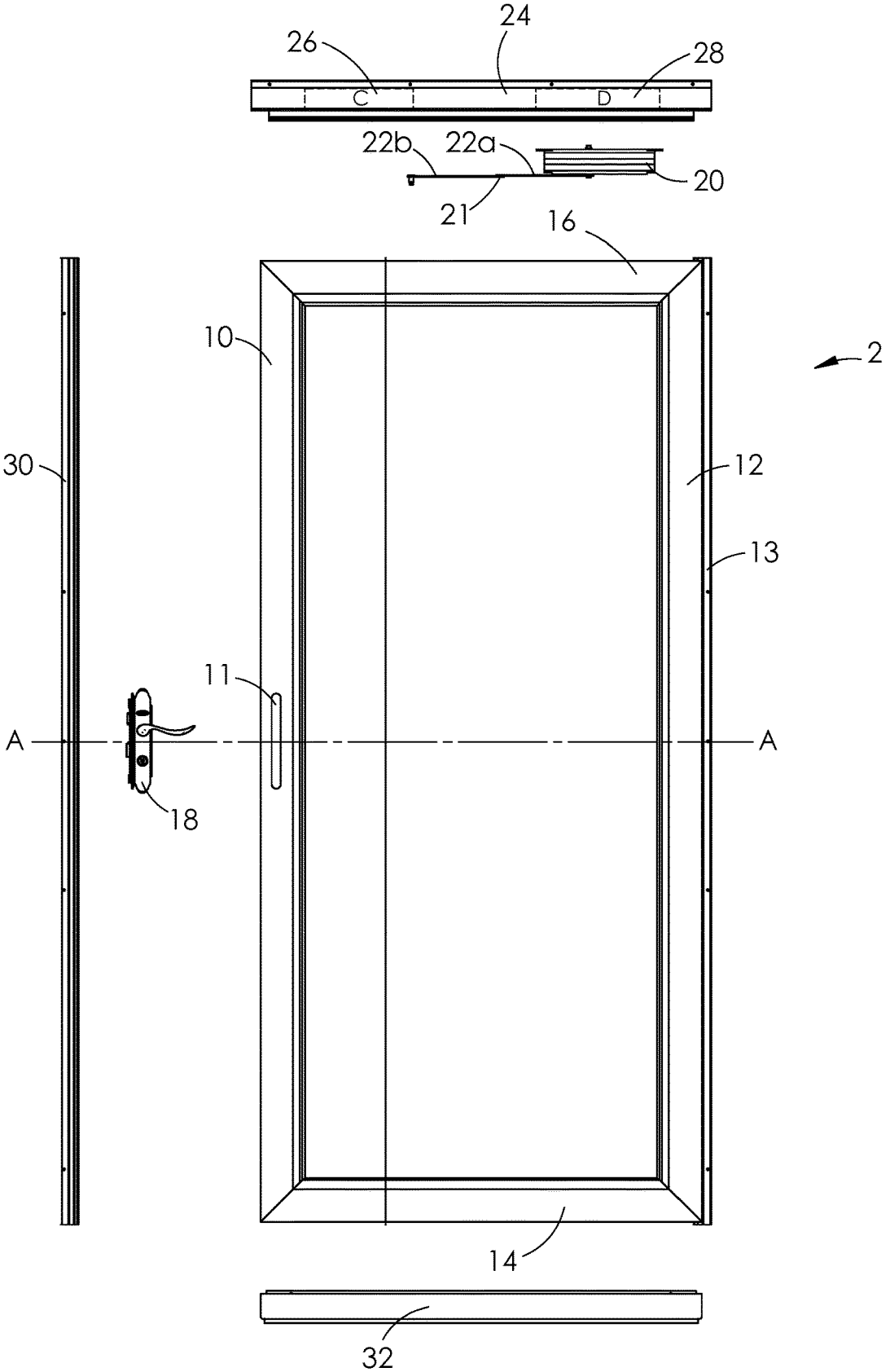

FIGS. 1A and 1B illustrate an embodiment of a door assembly that may be installed as either a left hinged or a right hinged door. The door assembly components in FIG. 1A include left hinged door frame 1 having vertical latch stile 10, vertical hinge stile 12, vertical hinge frame 13, upper horizontal rail 14 and lower horizontal rail 16. In this embodiment, vertical latch stile 10 includes a latch mechanism pocket 11 for fitting latch mechanism 18 to the latch stile 10. Other door assembly components illustrated in FIG. 1A include closer 20, closer arm 22*a*, 22*b*, which in use moves the door from an open position to a closed position, and drip cap 24. The closer arm is depicted as having a first piece 22*a* and a second piece 22*b* connected at a hinge 21. In an alternative embodiment, closer arm may comprise more than two pieces connected at more than one hinge. The closer arm 22*a*, 22*b* is capable of folding at hinge 21, wherein closer arm 22*b* and closer arm 22*b* are located side by side when folded at hinge 21. Alternatively, closer arm 22*a* is located on top of closer arm 22*b* when folded at hinge 21. Still further, if closer arm 22 comprises more than two pieces, each piece may be folded over at the hinge points to be located side by side, or in a stacked configuration. Each piece may be the same length, or alternatively, each piece may be different lengths. The hinge point may comprise an elbow hinge, a revolute joint, a knuckle joint, or other types of similar joints. Drip cap 24 includes two pockets 26 and 28 located near each end of the drip cap. Pockets 26 and 28 are used to fit or house closer 20 within the drip cap. FIG. 1A also illustrates vertical latch frame 30 and expander 32. Vertical latch frame 30 combines with latch mechanism 18 to latch and/or securely lock the door in closed position. Expander 32 may be fitted to the lower horizontal rail to adjust the bottom of the door to provide a desired seal between the door and the door threshold of the framed door opening.

The door assembly components in FIG. 1B generally correspond to the components of FIG. 1A, except that the door assembly is configured as a right hinged door. The conversion is readily accomplished because the components are essentially symmetrical about the A-A section line illustrated in FIG. 1A, allowing the door frame to be rotated 180° top-to-bottom to convert the left hinged door of FIG. 1A into the right hinged door of FIG. 1B (or vice versa). In FIG. 1B, reference numerals are the same for the same components of the door assemblies of FIG. 1A. Briefly, the door assembly components in FIG. 1B include right hinged door frame 2 having vertical latch stile 10, vertical hinge stile 12, vertical hinge frame 13, upper horizontal rail 16 and lower horizontal rail 14. In this embodiment, vertical latch stile 10 includes a latch mechanism pocket 11 for fitting latch mechanism 18 to the latch stile. Other door assembly components illustrated in FIG. 1B include closer 20, closer arm 22*a*, 22*b* which in use move the door from open position to a closed position as described above and drip cap 24. The closer arm is depicted as having a first piece 22*a* and a second piece 22*b* connected at a hinge 21. In an alternative embodiment, closer arm may comprise more than two pieces connected at more than one hinge. The closer arm 22*a*, 22*b* is capable of folding at hinge 21, wherein closer arm 22*b* and closer arm 22*b* are located side by side when folded at hinge 21. Alternatively, closer arm 22*a* is located on top of closer arm 22*b* when folded at hinge 21. Still further, if closer arm 22 comprises more than two pieces, each piece may be folded over at the hinge points to be located side by side, or in a stacked configuration. Each piece may be the same length, or alternatively, each piece may be different lengths. The hinge point may comprise an elbow hinge, a revolute joint, a knuckle joint, or other types of similar joints. Drip cap 24 includes two closer pockets 26 and 28 located near each end of the drip cap. Closer pockets 26 and 28 are used to fit or house closer 20 within the drip cap. FIG. 1B also illustrates vertical latch frame 30 and expander 32. Vertical latch frame 30 combines with latch mechanism 18 to latch and/or securely lock the door in closed position. Expander 32 may be fitted to the lower horizontal rail to adjust the bottom of the door frame to provide a desired seal between the door and the door threshold of the framed door opening.

Figure 2A:
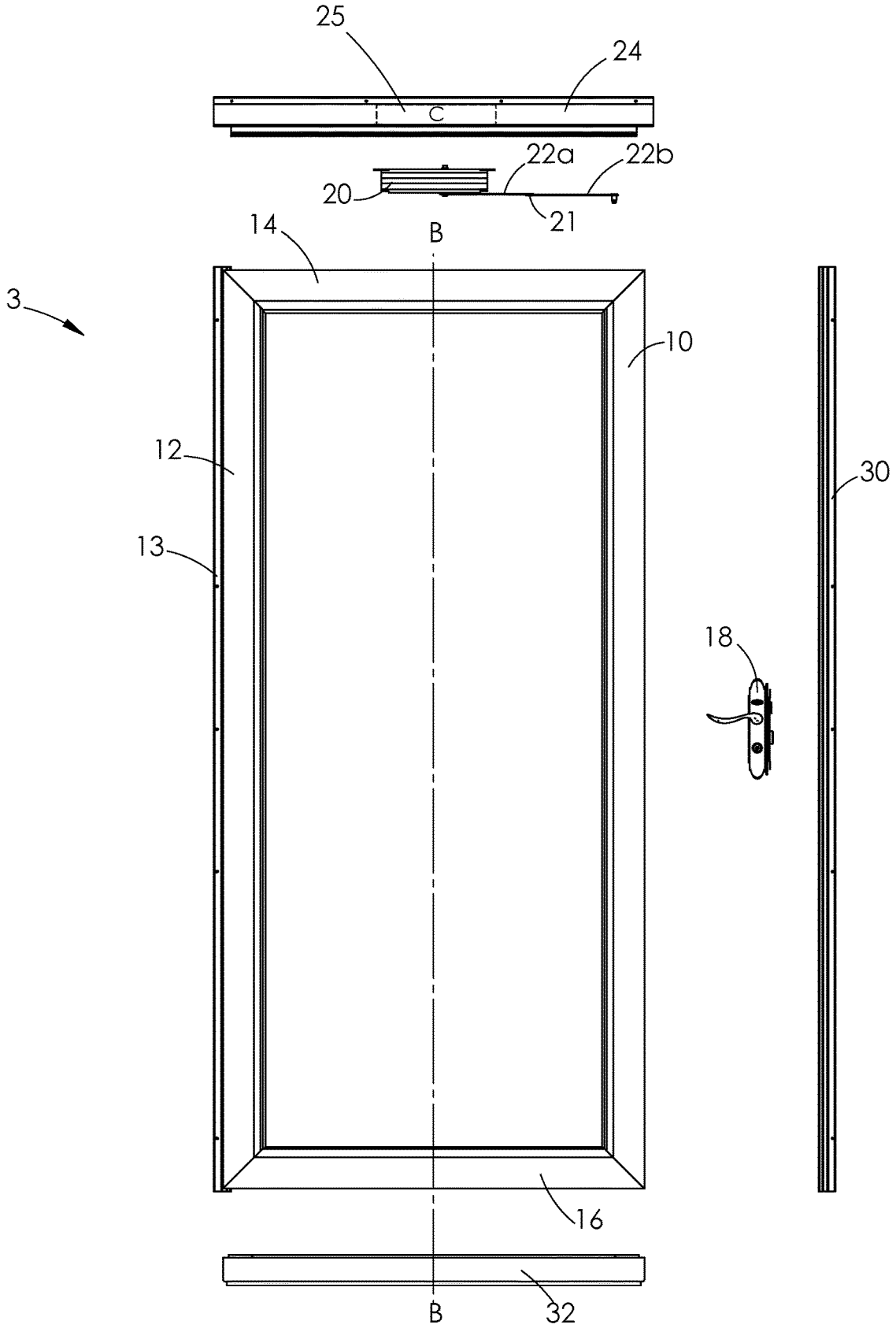
FIGS. 2A and 2B are exploded exterior front views of a left hinged door assembly (2A) and a right hinged door assembly (2B). Each door assembly in FIGS. 2A and 2B includes a door assembly, closer, drip cap having a centered closer pocket, lock set, vertical latch frame, vertical hinge frame and lower rail expander.
Figure 2B:
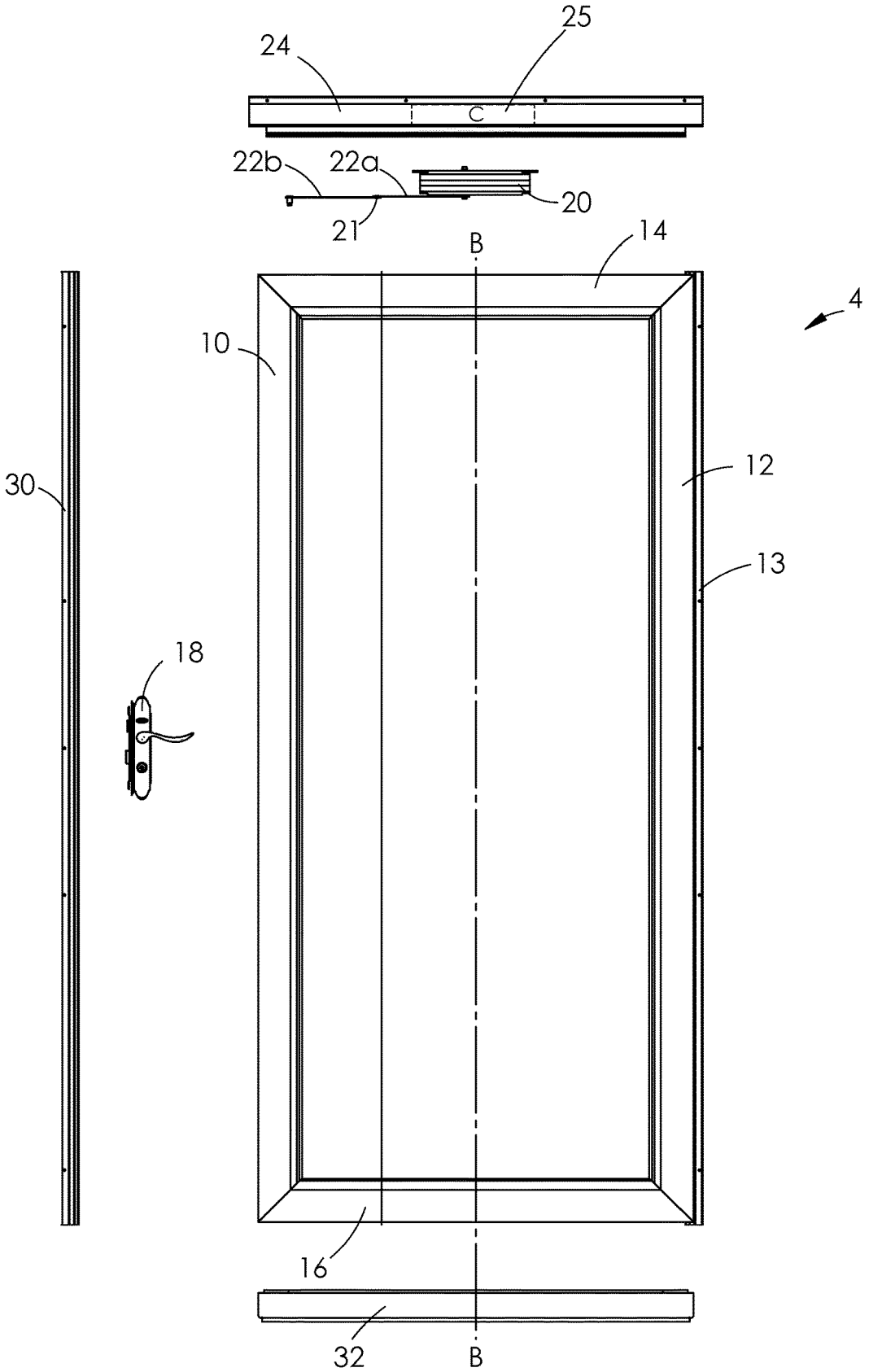

FIGS. 2A and 2B illustrate an embodiment of a door assembly that may be installed as either a left hinged or a right hinged door. The door assembly components in FIG. 2A include left hinged door frame 3 having vertical latch stile 10, vertical hinge stile 12, vertical hinge frame 13, upper horizontal rail 14 and lower horizontal rail 16. In this embodiment, latch mechanism 18 may be externally mounted to vertical latch stile 10. Other door assembly components illustrated in FIG. 2A include closer 20, closer arm 22*a*, 22*b* which in use move the door from an open position to a closed position, and drip cap 24. The closer arm is depicted as having a first piece 22*a* and a second piece 22*b* connected at a hinge 21. In an alternative embodiment, closer arm may comprise more than two pieces connected at more than one hinge. The closer arm 22*a*, 22*b* is capable of folding at hinge 21, wherein closer arm 22*b* and closer arm 22*b* are located side by side when folded at hinge 21. Alternatively, closer arm 22*a* is located on top of closer arm 22*b* when folded at hinge 21. Still further, if closer arm 22 comprises more than two pieces, each piece may be folded over at the hinge points to be located side by side, or in a stacked configuration. Each piece may be the same length, or alternatively, each piece may be different lengths. The hinge point may comprise an elbow hinge, a revolute joint, a knuckle joint, or other types of similar joints. Drip cap 24 includes one centered pocket 25 located in a center region of the drip cap 24. Pocket 25 is used to fit or house closer 20 within the drip cap 24. FIG. 2A also illustrates vertical latch frame 30 and expander 32. Vertical latch frame 30 combines with latch mechanism 18 to latch and/or securely lock the door in closed position. Expander 32 may be fitted to the lower horizontal rail to adjust the bottom of the door to provide a desired seal between the door and the door threshold of the framed door opening.

The door assembly components in FIG. 2B generally correspond to the components of FIG. 2A, except that the door assembly is configured as a right hinged door. The conversion is readily accomplished because the components are essentially symmetrical about the B-B section line illustrated in FIG. 2A, so that the vertical stiles may be configured and/or oriented as either a latch stile or as a hinge stile while maintaining the original orientation of the door frame. That is, the 180° rotation of the door frame described in conjunction with FIGS. 1B and 1B above is not necessary to convert the hinging of the door from left to right (or vice versa). Briefly, the door assembly components in FIG. 2B include right hinged door frame 4 having vertical latch stile 10, vertical hinge stile 12, vertical hinge frame 13, upper horizontal rail 14 and lower horizontal rail 16 (in FIG. 2B, reference numerals are the same for the same components of the door assembly of FIG. 2A). In this embodiment, latch mechanism 18 may be externally mounted to vertical latch stile 10. Other door assembly components illustrated in FIG. 2B include closer 20, closer arm 22*a*, 22*b* which in use move the door from open position to a closed position as described above and drip cap 24. The closer arm is depicted as having a first piece 22*a* and a second piece 22*b* connected at a hinge 21. In an alternative embodiment, closer arm may comprise more than two pieces connected at more than one hinge. The closer arm 22*a*, 22*b* is capable of folding at hinge 21, wherein closer arm 22*b* and closer arm 22*b* are located side by side when folded at hinge 21. Alternatively, closer arm 22*a* is located on top of closer arm 22*b* when folded at hinge 21. Still further, if closer arm 22 comprises more than two pieces, each piece may be folded over at the hinge points to be located side by side, or in a stacked configuration. The hinge point may comprise an elbow hinge, a revolute joint, a knuckle joint, or other types of similar joints. Drip cap 24 includes a centered closer pocket 25 located in a centered region of the drip cap 24. Closer pocket 25 is used to fit or house closer 20 within the drip cap 24. FIG. 2B also illustrates vertical latch frame 30 and expander 32. Vertical latch frame 30 combines with external latch mechanism 18 to latch and/or securely lock the door in closed position, or alternatively the installer could cut or drill the vertical stile to receive or be fitted with an internal latch mechanism. Expander 32 may be fitted to the lower horizontal rail to adjust the bottom of the door frame to provide a desired seal between the door and the door threshold of the framed door opening.

Figure 3A:
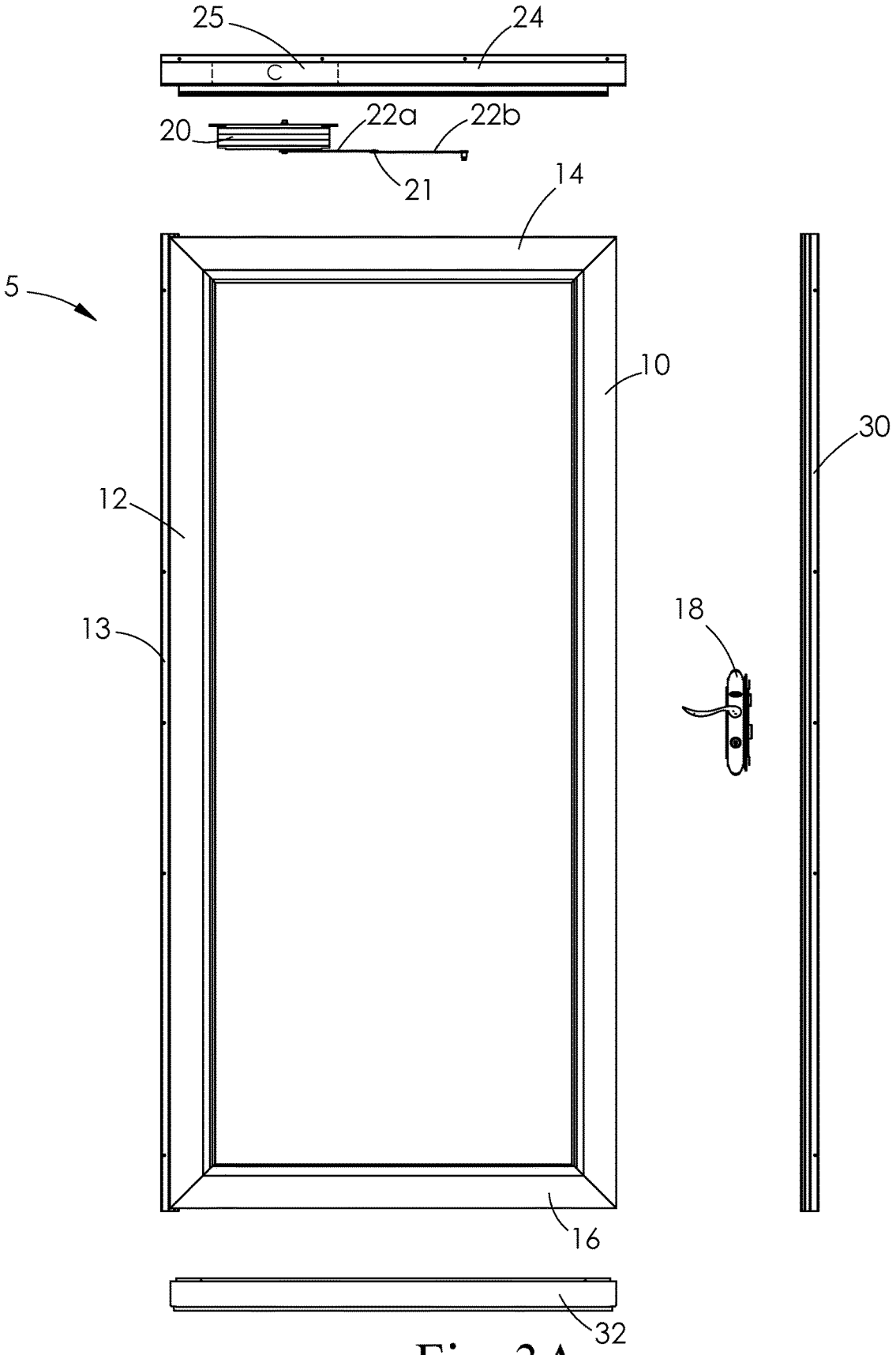
FIGS. 3A and 3B are exploded exterior front views of a left hinged door assembly (3A) and a right hinged door assembly (3B). Each door assembly in FIGS. 3A and 3B includes a door assembly, closer, drip cap with a single closer pocket, lock set, vertical latch frame, vertical hinge frame and lower rail expander.
Figure 3B:
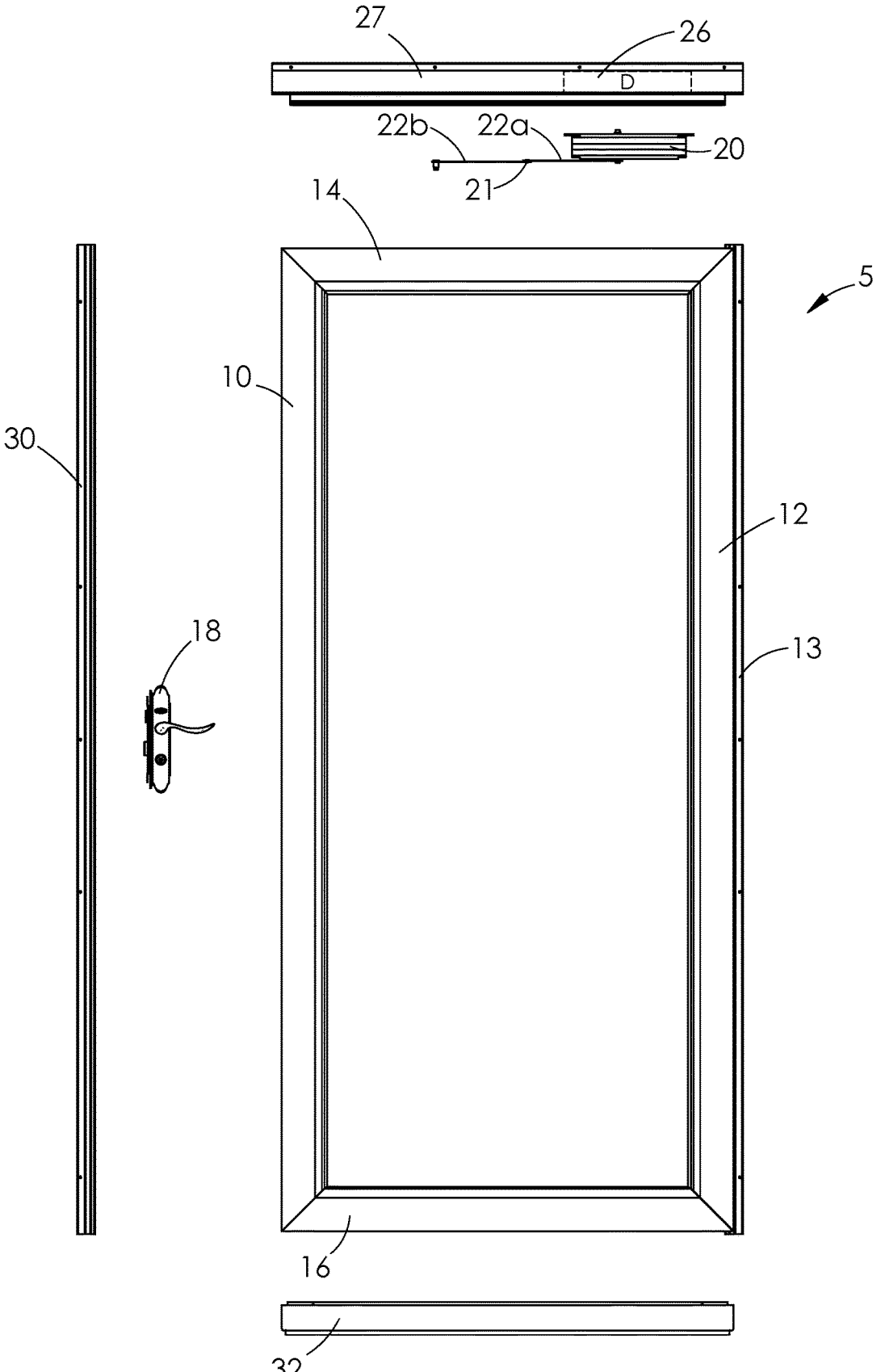

FIGS. 3A and 3B illustrate embodiments of a door assembly that may be installed as a left hinged door (FIG. 3A) or as a right hinged door (FIG. 3B), respectively. The door assembly components in FIG. 3A include left hinged door frame 5 having vertical latch stile 10, vertical hinge stile 12, vertical hinge frame 13, upper horizontal rail 14 and lower horizontal rail 16. In this embodiment, latch mechanism 18 may be externally mounted to vertical latch stile 10, or alternatively the installer could cut or drill the vertical stile to receive or be fitted with an internal latch mechanism. Other door assembly components illustrated in FIG. 3A include closer 20, closer arm 22*a*, 22*b* which in use move the door from an open position to a closed position, and drip cap 24. The closer arm is depicted as having a first piece 22*a* and a second piece 22*b* connected at a hinge 21. In an alternative embodiment, closer arm may comprise more than two pieces connected at more than one hinge. The closer arm 22*a*, 22*b* is capable of folding at hinge 21, wherein closer arm 22*b* and closer arm 22*b* are located side by side when folded at hinge 21. Alternatively, closer arm 22*a* is located on top of closer arm 22*b* when folded at hinge 21. Still further, if closer arm 22 comprises more than two pieces, each piece may be folded over at the hinge points to be located side by side, or in a stacked configuration. Each piece may be the same length, or alternatively, each piece may be different lengths. The hinge point may comprise an elbow hinge, a revolute joint, a knuckle joint, or other types of similar joints. Drip cap 24 includes a single pocket 25 located near the end of the drip cap 24 in a region adjacent to the vertical hinge frame. Pocket 25 is used to fit or house closer 20 within the drip cap. FIG. 3A also illustrates vertical latch frame 30 and expander 32. Vertical latch frame 30 combines with latch mechanism 18 to latch and/or securely lock the door in closed position. Expander 32 may be fitted to the lower horizontal rail to adjust the bottom of the door to provide a desired seal between the door and the door threshold of the framed door opening.

The door assembly components in FIG. 3B generally correspond to the components of FIG. 3A, except that the door assembly is configured as a right hinged door. In FIG. 3B, reference numerals are the same for the same components of the door assembly of FIG. 3A. Briefly, the door assembly components in FIG. 3B include right hinged door frame 6 having vertical latch stile 10, vertical hinge stile 12, vertical hinge frame 13, upper horizontal rail 14 and lower horizontal rail 16. In this embodiment, latch mechanism 18 may be either externally or internally mounted to vertical latch stile 10 as described above. Other door assembly components illustrated in FIG. 3B include closer 20, closer arm 22*a*, 22*b* which in use moves the door from an open position to a closed position as described above, and drip cap 27. The closer arm is depicted as having a first piece 22*a* and a second piece 22*b* connected at a hinge 21. In an alternative embodiment, closer arm may comprise more than two pieces connected at more than one hinge. The closer arm 22*a*, 22*b* is capable of folding at hinge 21, wherein closer arm 22*b* and closer arm 22*b* are located side by side when folded at hinge 21. Alternatively, closer arm 22*a* is located on top of closer arm 22*b* when folded at hinge 21. Still further, if closer arm 22 comprises more than two pieces, each piece may be folded over at the hinge points to be located side by side, or in a stacked configuration. Each piece may be the same length, or alternatively, each piece may be different lengths. The hinge point may comprise an elbow hinge, a revolute joint, a knuckle joint, or other types of similar joints. Drip cap 27 includes a single pocket 26 located near the end of the drip cap 24 in a region adjacent to the vertical hinge frame. Pocket 26 is used to fit or house closer 20 within the drip cap 27. FIG. 3B also illustrates vertical latch frame 30 and expander 32. Vertical latch frame 30 combines with latch mechanism 18 to latch and/or securely lock the door in closed position. Expander 32 may be fitted to the lower horizontal rail to adjust the bottom of the door frame to provide a desired seal between the door and the door threshold of the framed door opening.

Figure 4A:
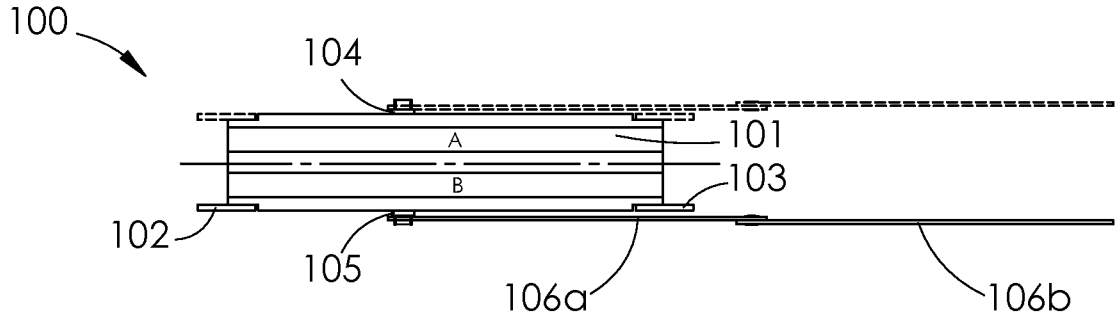
FIGS. 4A and 4B are front views of a left hinged door closer (4A) and closer arm and a right hinged door closer and closer arm (4B).
Figure 4B:
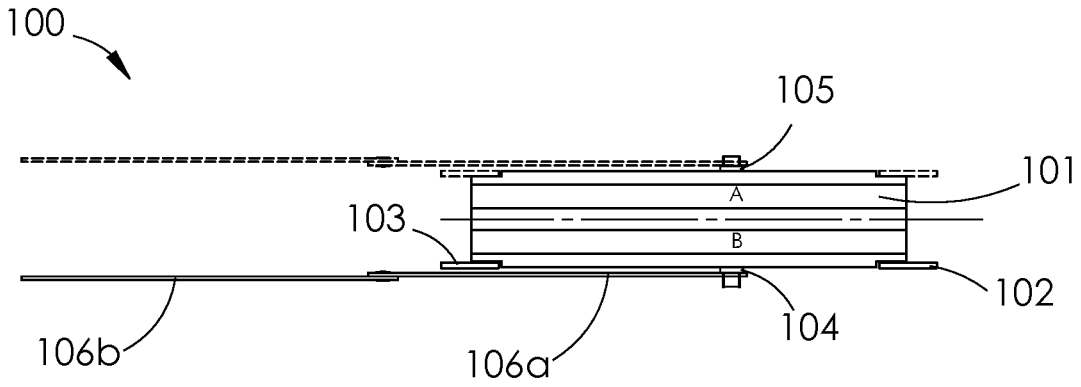

FIGS. 4A and 4B illustrate a closer 100 that may be used in both a left hinged or right hinged door. This illustrated closer 100, for example, may be used with door assemblies illustrated in FIGS. 1-3. The closer in FIGS. 4A and 4B has a closer body 101, a set of mounting tabs 102 and 103, and upper and lower connecting studs 104 and 105. FIGS. 4A and 4B also illustrate closer arm 106*a*, 106*b*. The closer arm is depicted as having a first piece 106*a* and a second piece 106*b* connected at a hinge point. Closer arm 106*b* pivots at the hinge point and can be located beneath closer arm 106*a*. While alternative types of hinges are described, FIG. 4A illustrates a revolute joint type. In use, mounting tabs 102 and 103 attach the closer body to a drip cap (not shown). Connecting studs 104 and 105 are attached to an internal pinion (not shown) in the closer body which provides rotational force to the connecting studs. When the closer arm 106*a*, 106*b* is attached to one of the connected studs, a rotational force is transmitted to closer arm 106*a*, 106*b* to the upper horizontal rail of the door assembly. The rotational movement of the closer arm 106*a*, 106*b* provides a force to move a door from an opened to closed position when the door is used. The closer 100, closer arm 106*a*, 106*b* may be used in either a left hinged door or a right hinged door depending on the configuration and orientation of the closer in the pocket in the drip cap. In particular, when the closer body 101 is attached to the drip cap with mounting tabs 102 and 103 in a pocket in the drip cap adjacent the vertical hinge stile region of the door with connecting stud 105 in a downward orientation as shown in FIG. 4A, the closer may be used in a left hinged door.

If the closer body is inverted and rotated end-for-end and inserted into a pocket (or channel, as described below) in the drip cap adjacent the vertical hinged stile region of the door with connecting stud 104 in a downward orientation as shown in FIG. 4B, the closer may be used in a right hinged door. The two different orientations of the closer 100 for use in either a left or right hinged door are further illustrated by the use of phantoms lines in both figures. The upper phantom lines illustrate the closer arm for the alternative hinged positions. The phantom closer arm illustrated in FIG. 4A set out a configuration of a right hinged door. Similarly, the phantom closer arm illustrated in FIG. 4B set out a configuration for a left hinged door. The specific orientation of the closer body also provides a particular rotation of the pinion and connecting studs. Specifically, when connecting stud 105 is in a downward orientation the connecting stud will rotate in one direction, for example in a clockwise direction. In contrast, when the connected stud 104 is in a downward orientation the connecting stud will rotate in the opposite direction, for example in a counterclockwise direction.

Those skilled in the art will readily recognize that alternate configurations for closer 100 are possible. For example, closer 100 could be configured such that connecting studs 104 and 105 are attached to separate internal pinions (not shown), and both extend through the same side of closer body 100, with one pinion and stud configured to rotate in a clockwise direction and the other pinion and stud configured to rotate in a counterclockwise direction. Closer 100 and closer arm 106*a*, 106*b* would be able to be used for both right hinged and left hinged doors by attaching the closer arm 106*a*, 106*b* to the appropriate connecting stud.

In some embodiments, the door assemblies of this disclosure may be fitting or attached in a closer pocket included in the drip cap. In other embodiments, the drip cap may be configured as a u-shaped groove that extends between each of the ends of the drip cap. Further, the u-shaped drip cap may have the open section of u-shaped channel facing downward toward the upper rail of the door frame or, alternatively the section of the u-shaped channel may face upwards away from the upper rail of the door frame.

Figure 5:
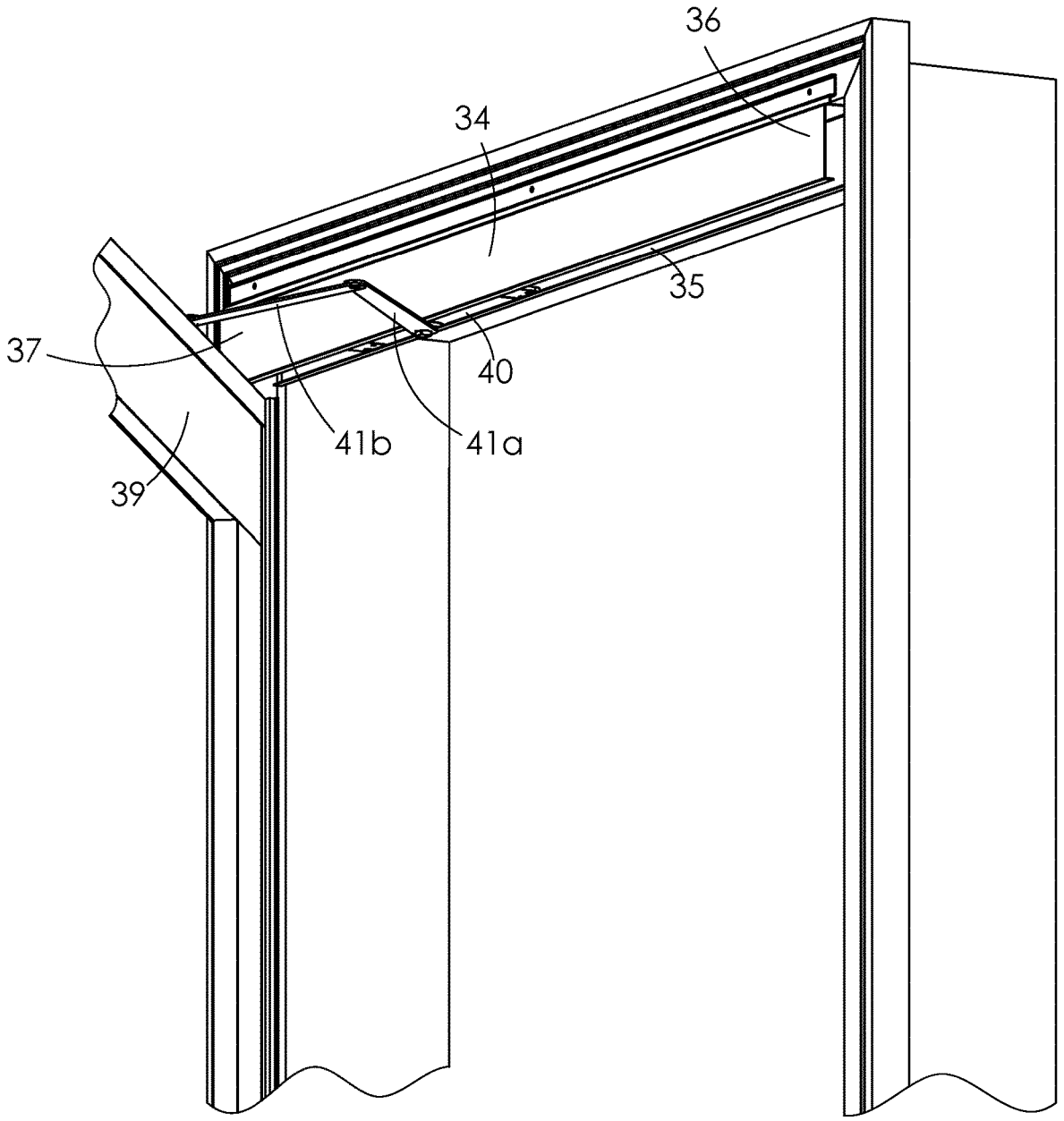
FIG. 5 is a perspective view of a door closer fitted in a downward facing opening in u-shaped channel in a drip cap.

FIG. 5 illustrates a drip cap having a u-shaped channel that extends between each of the ends of the drip cap. In this illustrated embodiment, the open section of the u-shaped channel faces downward toward the upper rail of the door frame. Specifically, FIG. 5 shows drip cap 34 having an open channel 35 extending between each end 36 and 37 of the drip cap. The open section of the channel in the drip cap faces the upper rail 39 of the door. FIG. 5 further illustrates door closer 40 fitted or housed in channel 35, as well as closer arm 41*a*, 41*b* secured to the upper rail of the door. A hold-open mechanism (not shown) may be adapted to the door, closer, closer arm and drip cap to limit the door swing as well as keep the door in a releasable stay-open position.

Figure 6:
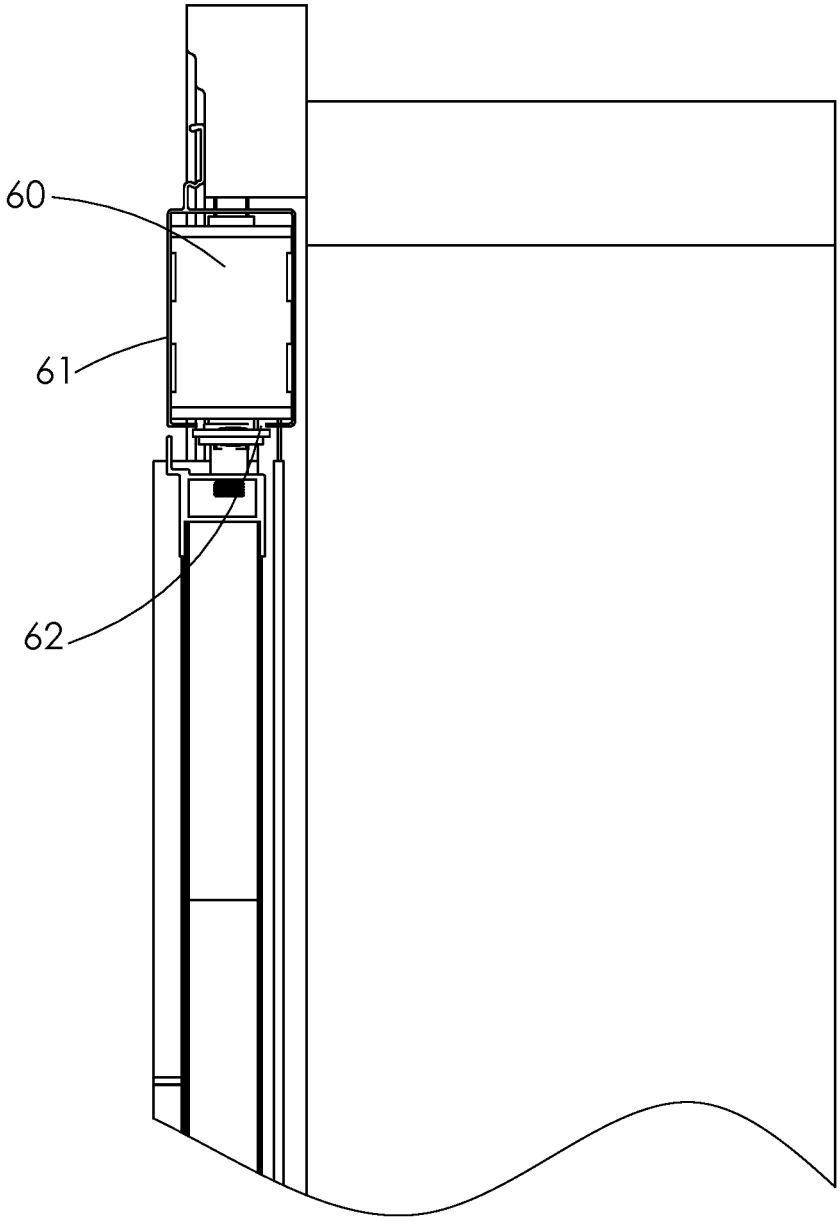
FIG. 6 is a cut away side view of the door assembly of FIG. 5 having a door closer fitted in a downward facing opening u-shaped channel in a drip cap.

FIG. 6 is a side view cross section that illustrates the closer body 60 inserted into a downward opening channel 62 of the drip cap 61.

Figure 7:
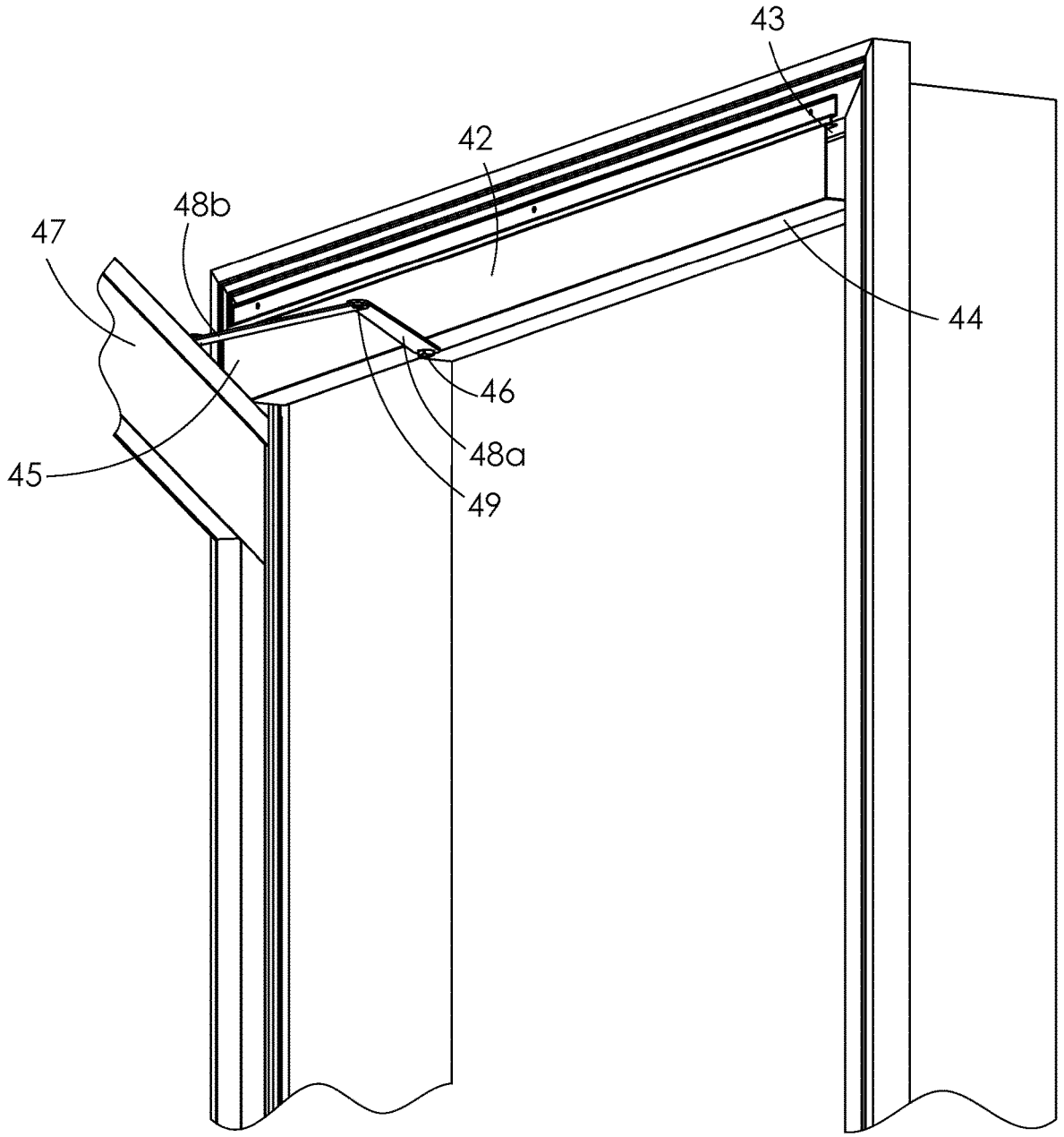
FIG. 7 is a perspective view of a hidden door closer fitted in an upward facing opening in a u-shaped channel in a drip cap.

FIG. 7 illustrates an alternative embodiment of a drip cap having a u-shaped channel that extends between each of the ends of the drip cap. In this embodiment, the open section of the u-shaped channel faces upward away from the upper rail of the door. FIG. 7 shows a drip cap 42 with a u-shaped channel 43 extending between the ends 44 and 45 of the drip cap. A door closer (not visible) is hidden or concealed in the channel. A connecting stud 46 of the hidden closer extends downward through an opening in drip cap 42 and is attached or secured to the closer arm 48*a*, 48*b*. The closer arm is depicted as having a first piece 48*a* and a second piece 48*b* connected at a hinge 49. In an alternative embodiment, the closer arm may comprise more than two pieces connected at more than one hinge. The closer arm 48*a*, 48*b* is also attached or secured to upper rail 47 of the door frame. A hold-open mechanism (not shown) may be adapted to the door, closer, closer arm and drip cap to limit the door swing as well as keep the door in a releasable stay-open position.

Figure 8:
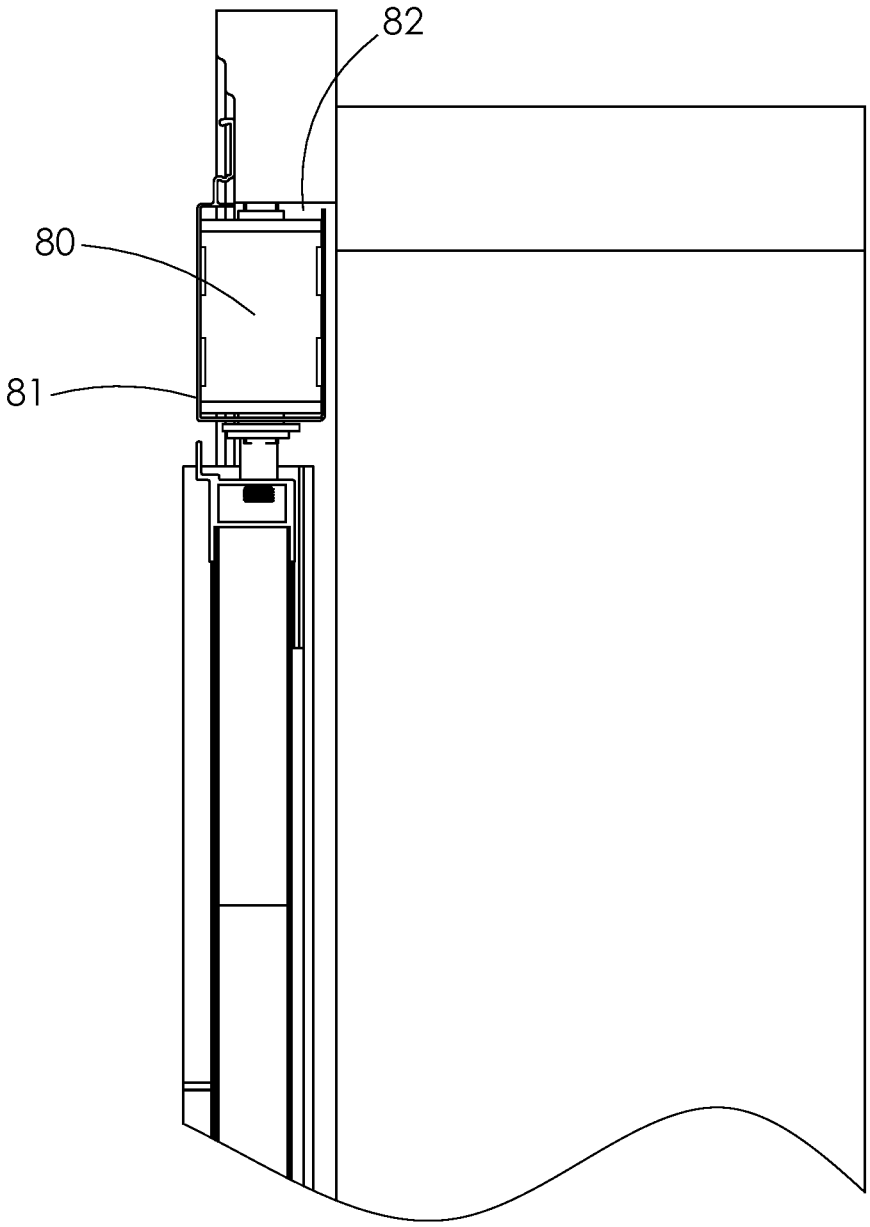
FIG. 8 is a cut away side view of the door assembly of FIG. 7 having a door closer fitted in an upward facing opening u-shaped channel in a drip cap.

FIG. 8 is a side view cross section that illustrates the closer body 80 inserted into an upward opening channel 82 of the drip cap 81.

Figure 9:
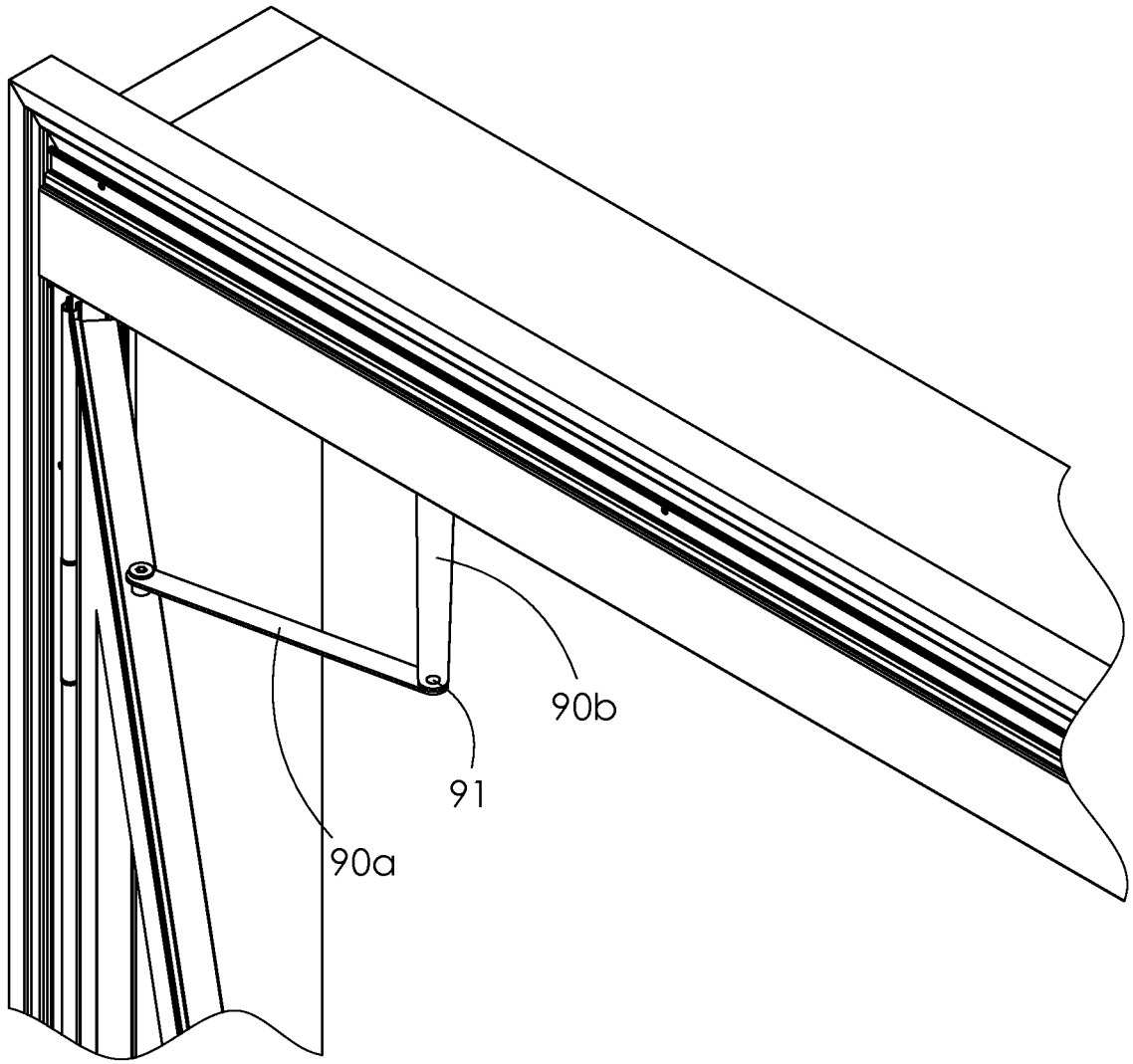
FIG. 9 is a perspective view of an upper rail of a left hinged door assembly.

FIG. 9 illustrates closer arm 90*a*, 90*b* attached to the upper horizontal rail of the door frame. Those skilled in the art will readily recognize that alternate configurations for closer arm 90*a*, 90*b* are possible. The closer arm is depicted as having a first piece 90*a* and a second piece 90*b* connected at a hinge 91. In an alternative embodiment, the closer arm may comprise more than two pieces connected at more than one hinge.

Figure 10:
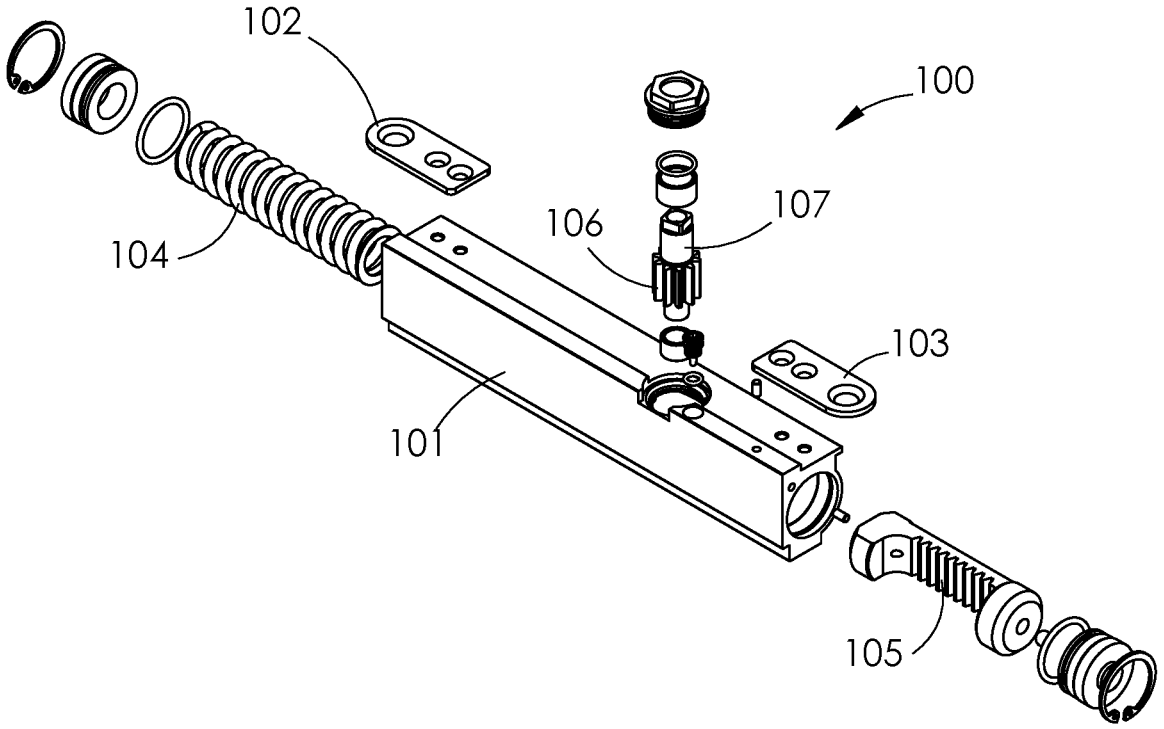
FIG. 10 is an exploded perspective view of an embodiment of a door closer.

FIG. 10 is an exploded perspective view of a mechanical spring closer 100. This closer includes a closer body 101 and mounting tabs 102 and 103. Mechanical biasing spring 104 is fitted in closer body 101 and connected to exert a force on geared rack 105. Geared pinion 106 is rotatably mounted in the closer body and is engaged with the geared rack to provide rotational motion as the rack is moved linearly. Geared pinion 106 includes connecting stud 107 which may be connected to a closer arm (not shown). As the connected closer arm is moved by opening and closing the door assembly (not shown), gear pinion 106 rotates and linearly displaces rack 105. The movement of the rack imparts a compressive force to spring 104. When the door assembly is released from an open position, sufficient force is transferred by the spring through the rack 105 and pinion 106 to the closer arm to move the door frame from the open position to the closed position by the rotation of the geared pinion and the resulting movement of the closer arm.

Figure 11:
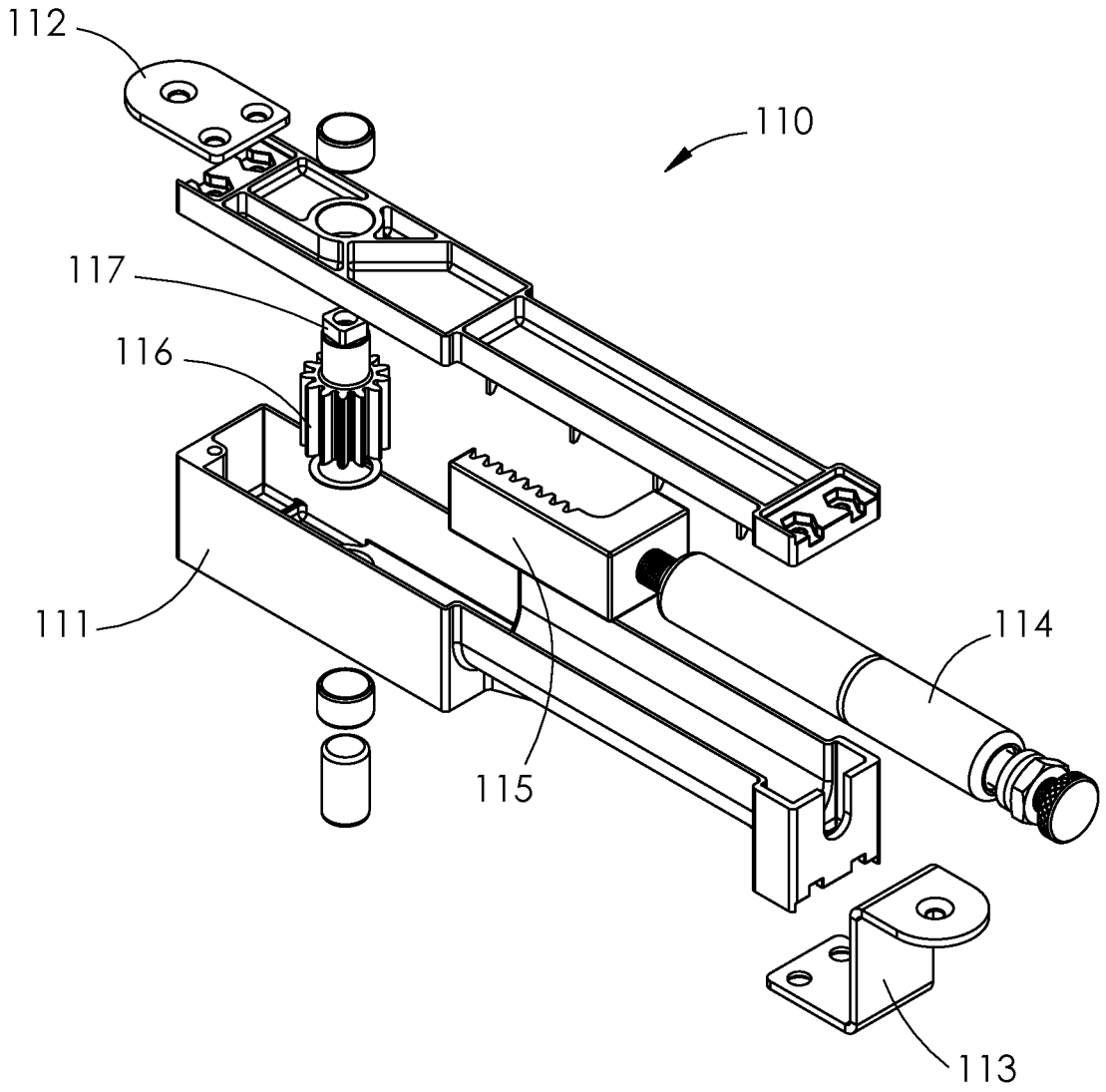
FIG. 11 is an exploded perspective view of an alternative embodiment of a door closer.

FIG. 11 is an exploded perspective view of gas spring closer 110. The components of this embodiment, including closer body 111 and mounting tabs 112 and 113, are substantially similar to the closer illustrated in FIG. 10 with the exception that the mechanical spring of FIG. 10 is replaced with gas spring 114. Gas spring 114 provides a similar force to geared rack 115 and geared pinion 116 as the geared pinion is rotated by the movement of a closer arm (not shown) which is connected to the geared pinion by connecting stud 117.

Those skilled in the art will readily recognize that any of the arrangements of door assemblies, latch and hinge frames, latch mechanisms, and expanders depicted in FIGS. 1A and 1B, 2A and 2B, and 3A and 3B can be combined with any of the arrangements of closers and drip caps depicted in FIGS. 1A and 1B, 2A and 2B, 3A and 3B, 5, 6, 7, and 8 to provide a left or right handed door with a closer concealed in a drip cap.

Alternative Embodiments of the Disclosed Invention

2 Pockets in Drip Cap

1. A first embodiment of a door assembly, comprising:
   - a door having first and second vertical stiles attached to upper and lower horizontal rails;
   - a drip cap having a horizontal body with first and second ends having two closer pockets located in regions of the horizontal body adjacent to the first and second ends;
   - a closer insertable into one of the pockets of the drip cap comprising a closer attachable to the drip cap, and a pinion rotatably connected to an internal biasing mechanism such as a biasing spring and having at least one connecting stud extending through the closer body, wherein the pinion provides sufficient rotational force to move the door from an opened position to a closed position; and
   - a closer arm having an attachment fixture on one end of the closer arm attachable to the pinion connecting stud and an attachment fixture on the opposite end of the closer arm attachable to the door, the closer arm comprising at least two segments connectable at a hinge.

Channel in Drip Cap

2. A second embodiment of a door assembly, comprising:
   - a door having one or more vertical stiles attached to upper and lower horizontal rails;
   - a drip cap having a horizontal body with first and second ends having an internal channel extending between the first and second ends;
   - a closer insertable into the internal channel of the drip cap comprising a closer body attachable to the drip cap, and a pinion rotatably connected to an internal biasing mechanism such as a biasing spring and having at least one connecting stud extending through the closer body, wherein the pinion provides sufficient rotational force to move the door from an opened position to a closed position; and
   - a closer arm having an attachment fixture on one end of the closer arm attachable to the pinion connecting stud and an attachment fixture on the opposite end of the closer arm attachable to the door, the closer arm comprising at least two segments connectable at a hinge.

Center Pocket in Drip Cap

3. A third embodiment of a door assembly, comprising:
   - a door having first and second vertical stiles attached to upper and lower horizontal rails;
   - a drip cap having a horizontal body with first and second ends having a closer pocket in a center region of the horizontal body between the first and second ends;
   - a closer insertable into the pocket of the drip cap comprising a closer body attachable to the drip cap, and a pinion rotatably connected to an internal biasing mechanism such as a biasing spring and having at least one connecting stud extending through the closer body, wherein the pinion provides sufficient rotational force to move the door from an opened position to a closed position; and
   - a closer arm having an attachment fixture on one end of the closer arm attachable to the pinion connecting stud and an attachment fixture on the opposite end of the closer arm attachable to the door, the closer arm comprising at least two segments connectable at a hinge Left or Right Hinged Door with Pocket in Drip Cap 4. Fourth and fifth embodiments of a door assembly for either a left or right hinged door with pocket in a drip cap comprising:
   - a door having first and second vertical stiles attached to upper and lower horizontal rails;
   - a drip cap having a horizontal body with first and second ends having one closer pocket located in a region of the horizontal body adjacent one of the ends of the drip cap for either a left hinged or a right hinged door assembly;
   - a closer insertable into the pocket of the drip cap comprising a closer body attachable to the drip cap, and a pinion rotatably connected to an internal biasing mechanism such as a biasing spring and having at least one connecting stud extending through the closer body, wherein the pinion provides sufficient rotational force to move the door from an opened position to a closed position; and
   - a closer arm having an attachment fixture on one end of the closer arm attachable to the pinion connecting stud and an attachment fixture on the opposite end of the closer arm attachable to the door, the closer arm comprising at least two segments connectable at a hinge.

5. A sixth embodiment of a door assembly kit, the door assembly kit comprising:
   - a door having first and second vertical stiles attached to upper and lower horizontal rails;
   - a drip cap having a horizontal body with first and second ends optionally having two closer pockets located in regions of the horizontal body adjacent to the first and second ends, an internal channel extending between the first and second end, a closer pocket in a center region of the horizontal body between the first and second ends, or one closer pocket located in a region of the horizontal body adjacent one of the ends of the drip cap;
   - a closer insertable into one of the pockets or the channel of the drip cap comprising a closer body attachable to the drip cap, and a pinion rotatably connected to an internal biasing mechanism such as a biasing spring and having at least one connecting stud extending through the closer body, wherein the pinion provides sufficient rotational force to move the door from an opened position to a closed position;
   - a closer arm having an attachment fixture on one end of the closer arm attachable to the pinion connecting stud and an attachment fixture on the opposite end of the closer arm attachable to the door, the closer arm comprising at least two segments connectable at a hinge;
   - an optional expander attachable to the lower horizontal rail;
   - a latch mechanism having latching components attachable to at least one of the vertical stiles in either an internal or an external configuration;
   - a vertical latch frame having optional fixtures to receive the latching components of the latch mechanism;
   - a vertical hinge frame attachable to at least one of the vertical stiles to provide either a left or right hinged door;
   - an optional cover attachable to the drip cap to conceal at least one of the closer pockets;
   - an optional hold-open mechanism; and
   - an optional screen insert, or one or more glass inserts, or both.

6. The door assembly of embodiments 1-5 or door kit of embodiment 6, wherein the door is a full view door, a high view door, or a mid-view door.

7. The door assembly of embodiments 1-5 or door kit of embodiment 6, wherein the door comprises seasonably exchangeable glass, opaque and/or screen panels, or glass, opaque and/or screen panels storable in designated sections of the door.

8. The door assembly of embodiments 1-5 or door kit of embodiment 6 further comprising a vertical hinge frame attached to at least one of the vertical stiles.

9. The door assembly of embodiments 1-5 or door kit of embodiment 6 further comprising a latch mechanism having latching components attachable to at least one of the vertical stiles.

10. The door assembly or door kit of embodiment 9 wherein the latch mechanism is externally mounted to at least one of the vertical stiles.

11. The door assembly or door kit of embodiment 9, wherein the latch mechanism is internally mounted in a latch pocket in at least one of the vertical stiles.

12. The door assembly of embodiments 1-5 or door kit of embodiment 6 further comprising a vertical latch frame attached to a door jamb adjacent at least one of the vertical stiles and having optional fixtures to receive the latching components of the latch mechanism.

13. The door assembly of embodiments 1-5 or door kit of embodiment 6 further comprising an expander attachable to the lower horizontal rail.

14. The door assembly of embodiments 1-5 or door kit of embodiment 6, wherein the internal biasing mechanism provides a torsional force or linear force.

15. The door assembly of embodiments 1-5 or door kit of embodiment 6, wherein the closer closes the door at a consistent speed or a variable speed.

16. The door assembly of embodiments 1-5 or door kit of embodiment 6, wherein the pinion has upper and lower connecting studs extending through a top and bottom of the closer body, and wherein the connecting stud rotates clockwise when the closer is in a first orientation in the closer pocket or channel, and counterclockwise when the closer is in a second orientation in the closer pocket or channel, or wherein the pinion has two connecting studs extending through either the top or bottom of the closer body, and wherein one connecting stud rotates clockwise when the closer is in the closer pocket or channel, and the other connecting stud rotates counterclockwise when the closer is in the closer pocket or channel.

17. The door assembly of embodiments 1-5 or door kit of embodiment 6, wherein the connecting stud rotates either clockwise or counterclockwise when displaced from a center biased position.

18. The door assembly of embodiments 1-5 or door kit of embodiment 6, wherein the closer comprises a dampener.

19. The door assembly of embodiment 1 or door kit of embodiment 6 further comprising a cover attachable to the drip cap to conceal an unused closer pocket.

20. The door assembly or door kit of embodiments 1-3 or 5, wherein the door frame can be installed as a left or right hinged door.

21. An embodiment of a method of mounting a door within a framed opening comprising:

a) providing a door assembly comprising:

1) a door having first and second vertical stiles attached to upper and lower horizontal rails;

2) a drip cap having a horizontal body with first and second ends optionally having two closer pockets located in regions of the horizontal body adjacent to the first and second ends, an internal channel extending between the first and second end, a closer pocket in a center region of the horizontal body between the first and second ends, or one closer pocket located in a region of the horizontal body adjacent one of the ends of the drip cap;

3) a closer insertable into one of the pockets or the channel of the drip cap comprising a closer body attachable to the drip cap, and a pinion rotatably connected to an internal biasing mechanism such as a biasing spring and having at least one connecting stud extending through the closer body, wherein the pinion provides sufficient rotational force to move the door from an opened position to a closed position;

4) a closer arm having an attachment fixture on one end of the closer arm attachable to the pinion connecting stud and an attachment fixture on the opposite end of the closer arm attachable to the door, the closer arm comprising at least two segments connectable at a hinge;

5) an optional expander attachable to the lower horizontal rail;

6) a latch mechanism having latching components attachable to at least one of the vertical stiles in either an internal or external configuration;

7) a vertical latch frame having optional fixtures to receive the latching components of the latch mechanism;

8) a vertical hinge frame attachable to at least one of the vertical stiles to provide either a left or right hinged door;

9) an optional cover attachable to the drip cap to conceal at least one of the closer pockets;

10) an optional hold-open mechanism; and 11) an optional screen insert, or one or more glass inserts, or both;

b) attaching the vertical hinge stile of the door assembly to a door jamb with the vertical hinge frame;

c) inserting the closer into one of the pockets or the channel in the drip cap;

d) attaching the closer arm to one of the closer pinion connecting studs;

e) attaching the drip cap to a door header;

f) attaching the vertical latch frame to the door jamb adjacent the vertical latch stile;

g) attaching the latch mechanism externally to or internally in the vertical latch stile;

h) attaching the closer arm to the door;

i) attaching the optional hold-open mechanism;

j) attaching the optional cover to the drip cap to conceal at least one of the unused closer pockets;

k) attaching the optional expander to the lower horizontal rail; and l) attaching the screen insert and/or one or more glass inserts in the door.

22. The method of embodiment 21, wherein the door is a full view door, a high view door, or a mid-view door.

23. The method of embodiment 21, wherein the door comprises seasonably exchangeable glass, opaque and/or screen panels, or glass, opaque and/or screen panels storable in designated sections of the door.

24. The method of embodiment 21, wherein the door can be installed as a left or right hinged door.

25. The method of embodiment 21 further comprising a vertical hinge frame attached to at least one of the vertical stiles.

26. The method of embodiment 21 further comprising a latch mechanism having latching components attachable to at least one of the vertical stiles.

27. The method of embodiment 28, wherein the latch mechanism is externally mounted to at least one of the vertical stiles.

28. The method of embodiment 28, wherein the latch mechanism is internally mounted in a latch pocket in at least one of the vertical stiles.

29. The method of embodiment 23 further comprising a vertical latch frame attached to a door jamb adjacent at least one of the vertical stiles and having optional fixtures to receive the latching components of the latch mechanism.

30. The method of embodiment 23 further comprising an expander attachable to the lower horizontal rail.

31. The method of embodiment 23, wherein the internal biasing mechanism provides a torsional force or linear force.

32. The method of embodiment 23, wherein the closer closes the door at a consistent speed or a variable speed.

33. The method of embodiment 23, wherein the pinion has upper and lower connecting studs extending through a top and bottom of the closer body, and wherein the connecting stud rotates clockwise when the closer is in a first orientation in the closer pocket or channel, and counterclockwise when the closer is in a second orientation in the closer pocket or channel.

34. The method of embodiment 23, wherein the pinion has two connecting studs extending through either the top or bottom of the closer body, and wherein one connecting stud rotates clockwise when the closer is in a the closer pocket or channel, and the other connecting stud rotates counterclockwise when the closer is in the closer pocket or channel.

35. The method of embodiment 23, wherein the connecting stud rotates either clockwise or counterclockwise when displaced from a center biased position.

36. The method of embodiment 23, wherein the closer comprises a dampener.

37. The door assembly of embodiments 1-5, the door kit of embodiment 6, or the method of embodiment 23, wherein the closer comprises one or more mounting tabs fastened to the closer body to attach the closer to the drip cap.

The invention claimed is:

1. A door assembly, comprising:

a door having first and second vertical edges and first and second horizontal edges;

a cap member attachable to a door opening above the first horizontal edge having a horizontal body with first and second cap ends having at least one of (i) plural closer pockets located in regions of the horizontal body adjacent to the first and second cap ends, (ii) an internal channel extending between the first and second cap ends, (iii) a closer pocket in a center region of the horizontal body between the first and second cap ends, and (iv) a closer pocket located in a region of the horizontal body adjacent one of the cap ends for either a left hinged or a right hinged door assembly;

a closer insertable into one of the pockets of the cap member or the channel, the closer comprising a closer body, a rotatable component operatively supported to the closer body, and an internal biasing device including a component movable to the closer body and operatively connected with the rotatable component, wherein the rotatable component provides sufficient rotational force to move the door from an opened position toward a closed position; and a closer arm having an attachment fixture on one end of the closer arm attached to or attachable to the rotatable component and an attachment fixture on an opposite end of the closer arm attachable to the door, the closer arm comprising at least two segments connected to or connectable at a hinge.

2. The door assembly of claim 1, wherein the door is a full view door, a high view door, or a mid-view door, and optionally comprising fixed glass, opaque or screen panels or combinations thereof; seasonably exchangeable glass, opaque or screen panels or combinations thereof; glass, opaque or screen panels or combinations thereof that are storable in designated sections of the door; or security or primary doors.

3. The door assembly of claim 1 further comprising a hinge element, wherein the hinge element comprises one of a vertical hinge frame attached to or attachable along at least one of the vertical edges, one or more hinges attached to or attachable along at least one of the vertical edges, and one or more hinge pins to provide a pivotal connection between the door and a door frame.

4. The door assembly of claim 1 further comprising a latch mechanism having latching components attached to or attachable to the door adjacent to one of the vertical edges.

5. The door assembly of claim 4 wherein the latch mechanism is either externally mounted to the door, or internally mounted in a latch pocket of the door.

6. The door assembly of claim 1 further comprising a vertical latch frame attached to or attachable to a door jamb adjacent at least one of the vertical edges and having optional fixtures to receive latching components of a latch mechanism.

7. The door assembly of claim 1 further comprising an expander attached to or attachable to the door proximate to the second horizontal edge.

8. The door assembly of claim 1, wherein the component movable to the closer body of the internal biasing mechanism provides a torsional force or linear force to the rotatable component.

9. The door assembly of claim 1, wherein the closer closes the door at a consistent speed or a variable speed.

10. The door assembly of claim 1, wherein the rotatable component has upper and lower connecting studs extending through a top and bottom of the closer body, and wherein the connecting studs rotate clockwise when the closer is in a first orientation in the closer pocket or channel, and counterclockwise when the closer is in a second orientation in the closer pocket or channel.

11. The door assembly of claim 1, wherein the rotatable component has two connecting studs extending through either the top or bottom of the closer body, and wherein one connecting stud rotates clockwise when the closer is in the closer pocket or channel, and the other connecting stud rotates counterclockwise when the closer is in the closer pocket or channel.

12. The door assembly of claim 1, wherein the rotatable component rotates either clockwise or counterclockwise when displaced from a center biased position.

13. The door assembly of claim 1, wherein the closer comprises a dampener.

14. The door assembly of claim 1 further comprising a cover attached to or attachable to the cap member to conceal an unused closer pocket.

15. The door assembly of claim 1, wherein the door can be installed as a left or right hinged door.

16. The door assembly of claim 1, wherein the closer comprises one or more mounting tabs provided to the closer body.

17. The door assembly of claim 1 further comprising a hold-open mechanism.

18. The door assembly of claim 1, wherein the cap member comprises a drip cap that is shaped to extend over the first or second door portion as an upper door portion for diverting fluid from above toward at least one cap member end.

19. A door assembly, comprising:

a door having first and second vertical edges and first and second horizontal edges;

a cap member attachable to a door opening above the first horizontal edge having a horizontal body with first and second cap ends having at least one of (i) plural closer pockets located in regions of the horizontal body adjacent to the first and second cap ends, (ii) an internal channel extending between the first and second cap ends, (iii) a closer pocket in a center region of the horizontal body between the first and second cap ends, and (iv) a closer pocket located in a region of the horizontal body adjacent one of the cap ends for either a left hinged or a right hinged door assembly;

a closer inserted within one of the pockets of the cap member or the channel, the closer comprising a closer body, a rotatable component operatively supported to the closer body, and an internal biasing device including a component movable to the closer body and operatively connected with the rotatable component, wherein the rotatable component provides sufficient rotational force to move the door from an opened position toward a closed position; and a closer arm having an attachment fixture on one end of the closer arm attached to or attachable to the rotatable component and an attachment fixture on an opposite end of the closer arm attachable to the door, the closer arm comprising at least two segments connected to or connectable at a hinge.

20. The door assembly of claim 19, wherein the component movable to the closer body of the internal biasing mechanism provides a torsional force or linear force to the rotatable component.

* * * * *